US010050356B2

(12) United States Patent
McConkey

(10) Patent No.: US 10,050,356 B2
(45) Date of Patent: Aug. 14, 2018

(54) HIGH TEMPERATURE VIBRATION RESISTANT SOLDERLESS ELECTRICAL CONNECTIONS FOR PLANAR SURFACES

(71) Applicant: Siemens Energy, Inc., Orlando, FL (US)

(72) Inventor: Joshua S. McConkey, Orlando, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 216 days.

(21) Appl. No.: 14/576,365

(22) Filed: Dec. 19, 2014

(65) Prior Publication Data

US 2016/0181707 A1 Jun. 23, 2016

(51) Int. Cl.

| | |
|---|---|
| ***H01R 4/30*** | (2006.01) |
| ***H01R 4/02*** | (2006.01) |
| ***H01R 4/46*** | (2006.01) |
| *H01R 12/50* | (2011.01) |
| *H01R 12/00* | (2006.01) |
| *H01R 12/52* | (2011.01) |
| *H01R 4/01* | (2006.01) |
| *H01R 4/245* | (2018.01) |
| *H01R 4/26* | (2006.01) |
| *H01R 4/2437* | (2018.01) |
| *H01R 4/34* | (2006.01) |
| *H01R 4/36* | (2006.01) |

(52) U.S. Cl.

CPC ..... *H01R 4/304* (2013.01); *H01R 4/021* (2013.01); *H01R 4/023* (2013.01); *H01R 4/302* (2013.01); *H01R 4/46* (2013.01); *H01R 4/01* (2013.01); *H01R 4/245* (2013.01); *H01R 4/2437* (2013.01); *H01R 4/26* (2013.01); *H01R 4/34* (2013.01); *H01R 4/36* (2013.01); *H01R 9/096* (2013.01); *H01R 12/52* (2013.01); *H01R 23/722* (2013.01); *H01R 23/725* (2013.01)

(58) Field of Classification Search

CPC ..... H01R 4/46; H01R 4/302; H01R 4/304; H01R 23/722; H01R 23/725; H01R 9/096; H01R 13/33; H01R 13/2412; H01R 12/52

See application file for complete search history.

(56) References Cited

U.S. PATENT DOCUMENTS 2,097,324 A 10/1937 Hill
2,218,016 A 10/1940 Anderson
(Continued)

*Primary Examiner* — Ishwarbhai B Patel
*Assistant Examiner* — Paresh Paghadal

(57) ABSTRACT

An electrical arrangement (10), including: a first conductor (12) having a first generally planar contact area (34); a second conductor (12) having a second generally planar contact area (40); an intermediate conductor (44) having a first faying area (84) overlying the first contact area and a second faying area (86) overlying the second contact area; a compression arrangement configured to compress the first faying area and the first contact area toward each other and to compress the second faying area and the second contact area toward each other; and a dimpling structure (46) effective to create plural contact points (74) between the first faying area and the first contact area and between the second faying area and the second contact area when the first and the second faying areas and the first and second contact areas are compressed toward each other by the compression arrangement.

12 Claims, 5 Drawing Sheets

(56) References Cited

U.S. PATENT DOCUMENTS

| | | | | | |
|---|---|---|---|---|---|
| 2,357,171 | A | | 8/1944 | Carlson | |
| 2,416,670 | A | | 3/1947 | Adams et al. | |
| 2,574,781 | A | | 11/1951 | Greene et al. | |
| 3,509,514 | A | | 4/1970 | Christensen et al. | |
| 4,560,224 | A | * | 12/1985 | Weisenburger | H01R 4/2495 439/422 |
| 4,658,504 | A | | 4/1987 | Sinharoy et al. | |
| 4,943,247 | A | * | 7/1990 | Wise | H01R 4/34 439/883 |
| 4,966,563 | A | | 10/1990 | Pierce et al. | |
| 4,983,132 | A | * | 1/1991 | Weidler | H01R 25/162 439/251 |
| 5,206,461 | A | | 4/1993 | Genzel et al. | |
| 5,709,553 | A | | 1/1998 | Opfer et al. | |
| 5,904,577 | A | | 5/1999 | Swansn et al. | |
| 6,024,611 | A | * | 2/2000 | Giuseppe | H01H 1/38 439/819 |
| 6,551,476 | B1 | * | 4/2003 | Scherba | C25C 3/12 204/243.1 |
| 8,662,940 | B2 | | 3/2014 | Decuyper et al. | |
| 9,441,114 | B2 | | 9/2016 | Kulkarni et al. | |
| 2006/0021303 | A1 | * | 2/2006 | Williams | F01N 3/027 55/282.3 |
| 2013/0244458 | A1 | * | 9/2013 | Falk | H01G 4/228 439/115 |

* cited by examiner

HIGH TEMPERATURE VIBRATION RESISTANT SOLDERLESS ELECTRICAL CONNECTIONS FOR PLANAR SURFACES

STATEMENT REGARDING FEDERALLY SPONSORED DEVELOPMENT

Development for this invention was supported in part by Contract No. DE-FE0005666, awarded by the United States Department of energy. Accordingly, the United States Government may have certain rights in this invention.

FIELD OF THE INVENTION

The invention relates to a secure, compact electrical arrangement used to establish an electrical connection between conductors used in a high temperature, high vibration environment.

BACKGROUND OF THE INVENTION

Conventional electrical connections such as wires soldered between traces and/or contacts and mechanical (e.g. crimped) connections between wires often suffice in relatively benign environments. However, a lifespan of these connections in relatively hostile environments such as those with a high temperature, temperature cycles, and/or high vibrations may be greatly reduced. For example, solder connections often weaken and then fail at solder joints due to long term vibration and thermal stresses. Typical solders melt at 180-250° C., which prevents their use in environments approaching these temperatures altogether. Higher temperature solders have melting temperatures starting at 450° C. Consequently, as the operating temperature increases, so does the difficulty in finding a suitable solder material. Platinum or gold bond wires have been used but these are fragile, sensitive to vibration, and require bulky equipment to implement, which precludes field implementation. Silver brazing likewise requires pieces to be inserted into furnaces at temperatures above 680° C., making it unsuitable for field work. Silver brazing also produces a connection that is sensitive to thermal stresses, resulting in lifting and cracking.

Various other solutions that forego the use of solder and instead rely on compression and friction (e.g. splices) for making electrical connections exist, but these are sensitive to vibration and thermal stresses. There are few options for making compact, secure electrical connections between electrical conductors to be used in a relative high temperature (500° C. and up) and high vibration environment (e.g. within an industrial gas turbine engine). There are even fewer options available when the conductors being connected are not wire, but are instead substantial conductors akin to, for example, a busbar. Consequently, there remains room for improvement in the art.

BRIEF DESCRIPTION OF THE DRAWINGS

The invention is explained in the following description in view of the drawings that show.

DETAILED DESCRIPTION OF THE INVENTION

The present inventor has devised an innovative, simple, inexpensive, and easy-to-implement electrical arrangement that establishes a reliable electrical connection between conductors used in high vibration and/or high temperature environments, including but not limited to an industrial gas turbine engine. The arrangement relies on friction to hold a flexible intermediate conductor against the contacting surface and within a compartment while permitting the intermediate conductor to slide relative to the conductors. The flexibility permits the conductor to flex to accommodate relative movement between the two conductors that occur as a result of the wide range of operating temperatures seen by the electrical arrangement. The sliding permits the intermediate conductor to maintain its structural integrity regardless of the relative positioning of the two conductors, and permits the conductor to eventually find an equilibrium position where faying surfaces of the intermediate conductor no longer move with respect to the conductors. The electrical arrangement includes a dimpling structure that dimples the faying surfaces to form plural contact points with the conductors which reduces the resistance there between significantly. With sufficient time in the equilibrium position and at the elevated operating temperatures the plural contact points may diffusion bond to the conductors, thereby establishing an even more secure electrical connection.

Figure 1:
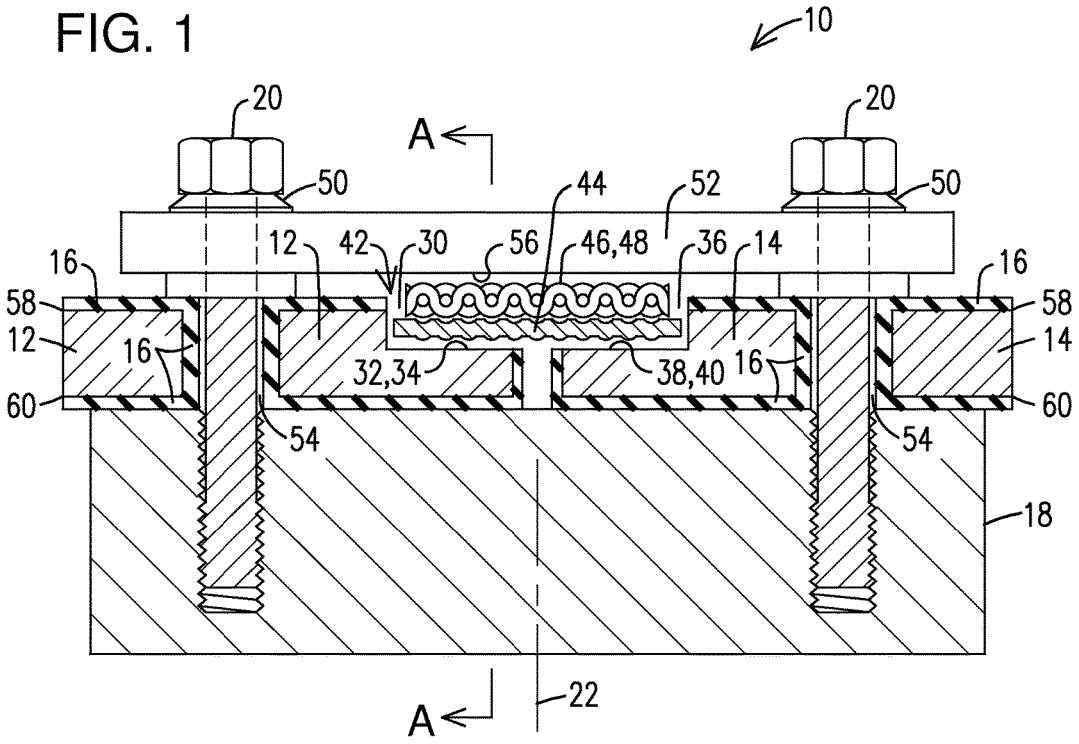
FIG. 1 is a side cross section of an exemplary embodiment of an electrical arrangement.

FIG. 1 is a side cross section of the electrical arrangement 10 disclosed herein and initially assembled to connect a first conductor 12 and a second conductor 14. The conductors may be covered with insulation 16 to electrically separate them from a backing member 18 that may or may not be made of a conductive material such as steel, as well as bolts 20 that likewise may or may not be made of a conductive material such as steel. In an exemplary embodiment not meant to be limiting, the first conductor 12 and the second conductor 14 may be planar, may be one of several conductors connected together, and/or may be oriented vertically. In such an exemplary embodiment the view of FIG. 1 would be looking vertically and the backing member 18 may be a gas turbine engine component positioned as shown with respect to a longitudinal axis 22 of the gas turbine engine. However, the conductors may come in any shape amenable to being connected using the principles disclosed herein.

The first conductor 12 includes a first conductor recess 30 having a bottom 32 that includes a first contact area 34. Likewise, the second conductor 14 includes a second conductor recess 36 having a bottom 38 that includes a second contact area 40. In an exemplary embodiment the first and second contact areas 34, 40 may be generally planar. As used herein generally planar is meant to include structures that are essentially flat but that may have some local surface imperfections. Generally planar also recognizes that there may be local dimpling of the surface area as a result of the compression upon assembly for certain embodiments.

Together the first conductor recess 30 and the second conductor recess 36 cooperate to form a compartment 42 in which an intermediate conductor 44 made of a compliant material and a dimpling structure 46 are disposed. In the exemplary embodiment shown the dimpling structure 46 is a wire mesh 48. The bolts 20 apply compressive force to an optional compliant fastener component 50 (e.g. a spring washer) that in turn applies the compressive force to a structural member 52. As a result, the structural member 52 and the backing member 18 sandwich and compress together the first and second conductors 12, 14, the intermediate conductor 44, and the dimpling structure 46. Together, the bolts 20, the compliant fastener component 50, the structural member 52, and the backing member 18 constitute a compression arrangement of the exemplary embodiment. However, other compression arrangements are envisioned so long as they are in keeping with the principles disclosed herein.

In the exemplary embodiment where the electrical arrangement 10 is part of an industrial gas turbine the electrical arrangement 10 may see a wide range of temperatures. During periods of shut down the temperature may be ambient/atmospheric. During operation the temperature may reach up to 500° C. and up, and further may fluctuate depending on the load. Consequently, the electrical arrangement 10 not only includes materials that can withstand those temperatures, but the components are arranged to accommodate relative movement of any of the components with respect to other components that may result from differing coefficients of thermal expansion. (Such relative movement is non-trivial when there is a 500+° C. temperature range.) For example, the compliant fastener component 50 accommodates relative growth of the bolts 20. Bolt holes 54 through the conductors may likewise be larger than a diameter of the bolts 20 to accommodate any lateral relative movement of the bolts 20.

In an exemplary embodiment the structural member 52 may include a non-conductive material such as a ceramic matrix composite (CMC) material, which is also relatively rigid even at high temperatures and is characterized by a relatively low coefficient of thermal expansion. The structural member 52 may have a planar structure. In particular, a bottom surface 56 of the structural member 52 may be planar to ensure even distribution of compressive forces to the dimpling structure 46 and ultimately to the intermediate conductor 44. Alternately, the structural member 52 may be a conductive material, provided it is electrically isolated from the first conductor 12 and the second conductor 14. The insulation 16 in the bolt holes 54 and on a top 58 and bottom 60 of the conductors may provide sufficient electrical insulation. Alternately, or in addition, electrically isolating bushings (not shown) could be used between the bolts 20 and the structural member 52.

The electrical arrangement 10 shown is free of solder joints, and is initially free of any metallurgical bonds whatsoever. This eliminates any need for heat and as a result building and/or repairing the electrical arrangement is simply a matter of assembling the components and fastening them together by hand. Consequently, unlike others, this electrical arrangement 10 is well suited for field work.

The mesh 48 is used in this exemplary embodiment to overcome potential issues that may otherwise arise when trying to make electrical connections between two contact areas using a relatively smooth intermediate member. Specifically, without the mesh 48 the electrical interfaces may suffer increased resistance due to uneven first and second contact areas 34, 40 of the first and second conductors 12, 14, an uneven bottom surface 56 of the structural member, and/or a relatively rigid intermediate conductor 44 that may not adjust to overcome these factors. Therefore, one role of the mesh 48 is to spread out the compressive force delivered by the structural member 52 to the intermediate conductor 44.

Figure 2:
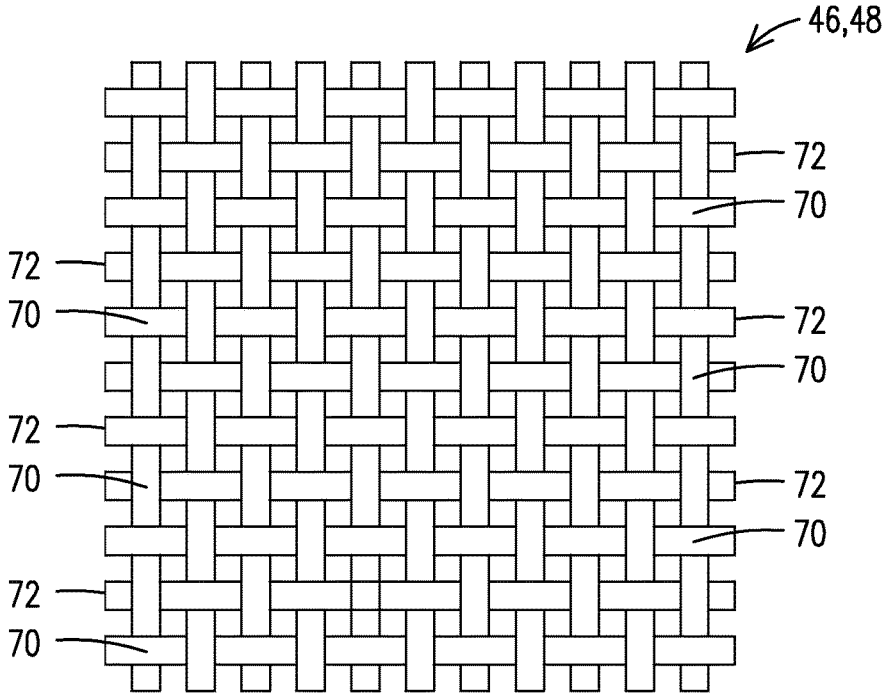
FIG. 2 is a top view of mesh used in the electrical arrangement of FIG. 1.
Figure 3:
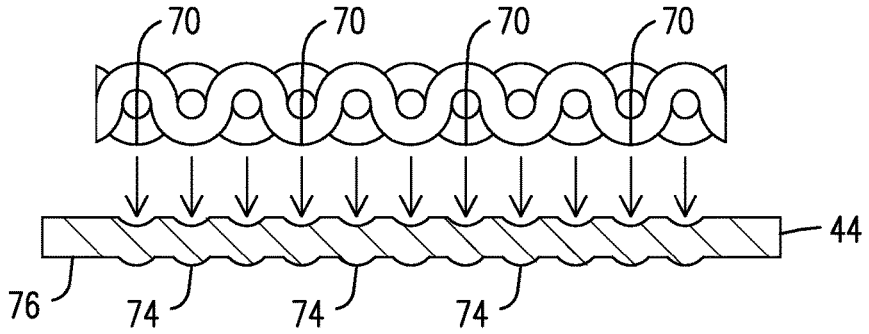
FIG. 3 is a side view of the mesh and the intermediate conductor of FIG. 1.

As can be seen in FIGS. 2-3, the mesh 48 forms a plurality of peaks 70 that occur where individual wires 72 cross. The intermediate conductor may be selected so that when pressed together in the electrical arrangement 10, the plurality of peaks deform the compliant intermediate conductor 44. This, in turn, forms a plurality of raised contact points 74 on a contact side 76 of the intermediate conductor 44. The plurality of raised contact points 74 interface with the first contact area 34 and the second contact area 40 in a manner that is significantly more electrically conductive when compared to an undeformed contact side 76 of the intermediate conductor 44 due at least in part to a higher contact pressure. The plurality of raised contact points 74 may be slightly larger than the plurality of peaks 70 due to a blunting effect resulting from a thickness of the intermediate conductor 44. This may strike a balance between increased contact area and increased contact pressure. Thus, a second role of the dimpling structure 46/mesh 48 is to physically deform the intermediate conductor 44 to improve the electrical connection with the first and second contact areas 34, 40.

Figure 4:
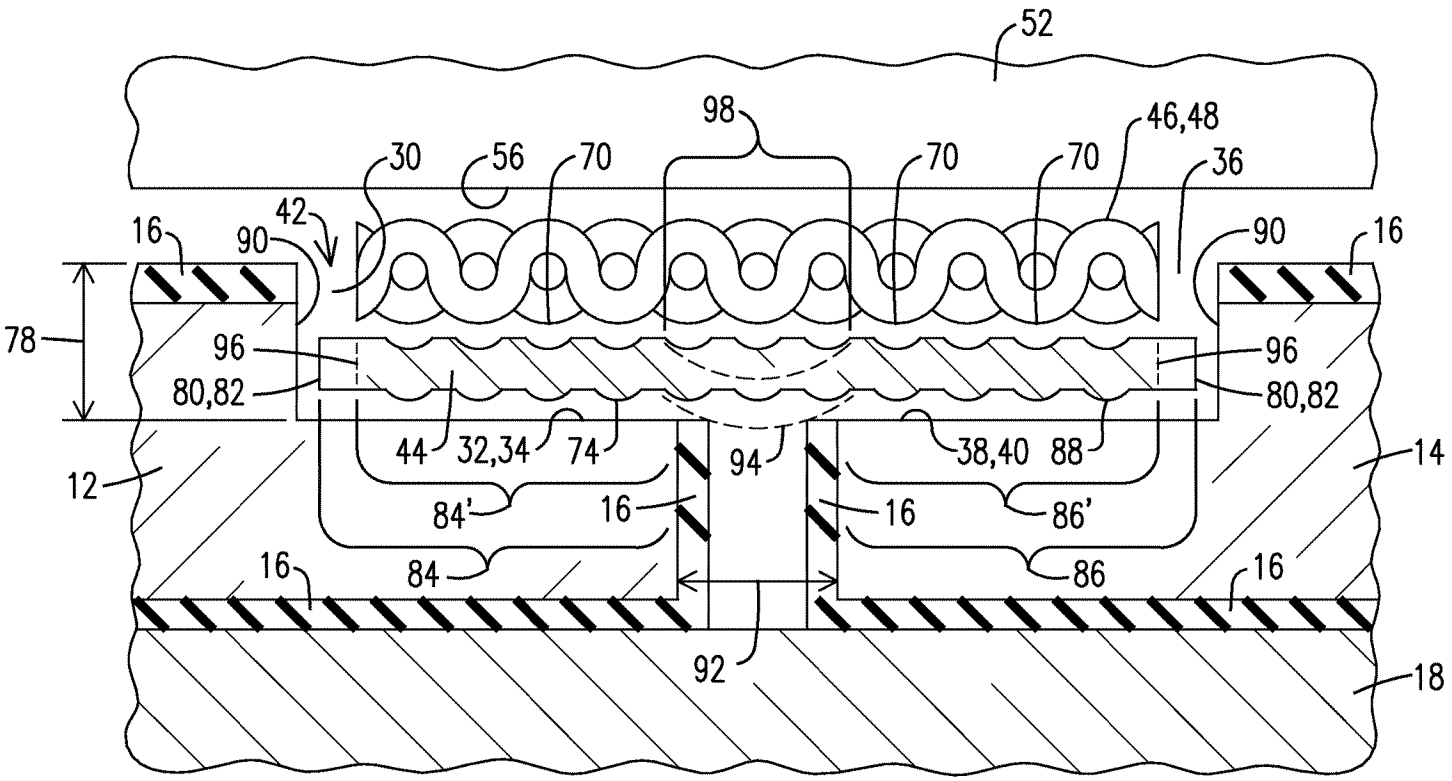
FIG. 4 is a close up of the cross section of FIG. 1.

FIG. 4 is a close up of the cross section of FIG. 1. Visible is the structural member 52 overlying the dimpling structure 46/mesh 48, which overlies the intermediate conductor 44, which overlies both the first contact area 34 and the second contact area 40, with the backing member 18 underlying all the other components. In order for the compression to be properly effected the intermediate conductor 44 and the mesh 48 must extend above the first and second conductors 12, 14 before assembly. If a thickness of the intermediate conductor 44 and a thickness of the mesh 48 alone are insufficient to extend above the first and second conductors 12, 14 then another filler piece (not shown) may be placed between the structural member 52 and the mesh 48. The filler piece may be essentially anything that remains chemically stable at the anticipated operating temperatures. For example, the filler piece may be a single layer or a folder layer of gold or silver foil similar to the intermediate conductor 44. Alternately, steel or CMC etc. may be used. Once assembled and compressed to an operating configuration a recess depth 78 cannot exceed a thickness of the intermediate conductor 44 and a thickness of the mesh 48 and any filler piece(s). In an exemplary embodiment, once assembled, a distance from the bottom surface 56 to the first and second contact areas 34, 40 is greater than the recess depth 78.

An undashed perimeter 80 of the intermediate conductor 44 shows it in an original position 82 when first assembled and at ambient temperature. In the original position 82 the intermediate conductor has a first faying area 84 and a second faying area 86. As used herein a faying area is a portion of the intermediate conductor 44 in actual contact with the respective contact area 34, 40 at any given point in time. Thus, the compressive force presses the first and second faying areas 84, 86 on a contact side 88 of the intermediate conductor 44 toward the first and second contact areas 34, 40 respectively.

The intermediate conductor 44 is intentionally assembled with compressive force applied to a side opposite the contact side 88 sufficient for it to maintain good electrical contact with the first and second contact areas 34, 40, but not too much so as to prevent it from sliding relative to the first and second contact areas 34, 40 during operation. This is done to accommodate relative thermal growth etc. This freedom may also cause the intermediate conductor 44 to migrate/slide as a result of vibrations experienced during operation. Consequently, as the intermediate conductor 44 moves, the first and second faying areas 84, 86 may change. For example, the intermediate conductor 44 may move to the right, to the left, and into and out of the page until it reaches a compartment perimeter 90 that may constrain the intermediate conductor 44 in any or all of those directions.

During operation of sufficient duration, which may or may not include one or more shut downs and start up, the intermediate conductor 44 may eventually reach an equilibrium position. To illustrate, in the exemplary embodiment the first conductor 12 and the second conductor 14 are positioned end to end and define a gap 92 there between. When initially assembled the gap 92 may be characterized by an ambient temperature dimension (shown). The intermediate member may be assembled in the original position 82 where it is fully stretched, or it may become fully stretched during operation but before the highest operating temperatures are experienced. During operation the temperature may increase from an ambient temperature of 25° C. to 550° C. The gap 92 may grow significantly and may be characterized by a larger base-load temperature dimension (not shown).

The compression arrangement exerts a compressive force on the intermediate conductor 44, which presses the intermediate conductor 44 onto the first and second contact areas 34, 40. This creates frictional forces between the intermediate conductor 44 and the first and second contact areas 34, 40. Material for the intermediate conductor 44 is chosen such that it has a tensile yield strength that is greater than the frictional forces generated at all operating temperatures. This enables the intermediate conductor 44 to retain its structural integrity and slide along the first and second contact areas 34, 40 after it has been stretched to its maximum length should the first and second contact areas 34, 40 continue to separate. Since the intermediate conductor 44 is able to slide relative to the first and second contact areas 34, 40, it will do so to accommodate the increased size of the gap 92. If the intermediate conductor 44 were not able to slide relative to the first and second contact areas 34, 40, then it would tear. This could sever the electrical connection entirely. In an exemplary embodiment where the mesh 48 is a steel mesh, then the mesh 48 can act as a backup intermediate conductor.

For sake of clarity it is assumed that the intermediate conductor 44 remains centered when sliding. As a result, at operating temperature, there may be a first faying area 84' and a second faying area 86', both of which are reduced compared to the first faying area 84 and the second faying area 86. During a subsequent shutdown of the engine the gap 92 will return to the ambient temperature dimension shown. As the gap 92 decreases during the cooling associated with the shutdown, the intermediate conductor, being compliant/flexible, may not slide along the first and second contact areas 34, 40 to return to its original position 82. Instead, the reduced first and second faying areas 84', 86' may remain and excess length may simply cause the intermediate conductor to form a bow 94 in the gap 92. If the gap 92 never increases beyond the base-load temperature of the above example such that no further sliding ever occurs, then the intermediate conductor 44 can be considered to have reached an equilibrium position 96. It is understood that it may take one or more start up/shutdown cycles and/or time in operation at various load conditions for the intermediate conductor 44 to reach the equilibrium position 96.

In this exemplary embodiment the mesh 48 will be selected so that it does not interfere with the positioning of the intermediate conductor 44. By its construction the mesh 48 can stretch left and right and into and out of the page. When initially installed the mesh 48 may be in a neutral position, being neither expanded nor compressed from left to right or into or out of the page. The mesh 48 may hold its position relative to the intermediate conductor 44 in the positioning process described above. Once cooled, a spanning part 98 of the mesh 48 immediately overlying the bow 94 in the intermediate conductor 44 may simply compress. As a result both the intermediate conductor 44 and the mesh 48 have a built-in amount of slack at ambient/atmospheric temperature that allows for relative thermal growth at all operating conditions. The mesh 48 may also be selected such that it's coefficient of thermal expansion is correlated to the coefficient of thermal expansion of the intermediate conductor 44 to prevent relative thermal growth there between.

Since the slack is created as a result of thermal conditions and associated thermal growth experienced by that specific electrical arrangement 10 in that specific location of that engine, the amount of slack will be specifically tailored for that exact connection. Other electrical arrangements 10 disposed at other locations and/or in other engines may experience slightly different operating temperatures, different gap sizes, and other variations. Thus, even if the various electrical arrangements are identical initially, each one may vary slightly once it has seen operation. This variation among electrical connections is thus anticipated and intentionally enabled through the flexibility of the electrical arrangement 10 disclosed herein.

Once in the equilibrium position the plurality of raised contact points 74 would not move with respect to the first and second contact areas 34, 40, and as a result the plurality of raised contact points 74 will be in intimate contact with the first and second contact areas 34, 40 for extended times at elevated temperatures (e.g. 550° C.). These conditions are sufficient to cause diffusion bonding of properly matched materials. Thus, the intermediate conductor 44 may be selected to include a material that will diffusion bond with the first and second contact areas 34, 40 once the intermediate conductor reaches an equilibrium position 96. It is understood that a rate of movement of the intermediate conductor may slow to a relative crawl over time without truly stopping, or that there may not be a true equilibrium position for all operating conditions. Thus, the intermediate conductor 44 may never reach an equilibrium position. Alternately, diffusion bonding may initiate and then halt if the bond is broken as a result of micro-migrations. In that case the equilibrium position may be considered reached if diffusion bonding occurs in a manner sufficient to hold the intermediate conductor 44 in the equilibrium position 96 despite an existing desire to micro-migrate.

In instances where it is seen as desirable to have the intermediate conductor 44 bond in the equilibrium position 96 sooner rather than later, or simply to have the intermediate conductor 44 diffusion bond to any position close enough to equilibrium, a material for the intermediate conductor 44 may be selected that is known to diffusion bond relatively quickly. Should the true equilibrium position 96 be sought, or if a relatively weak diffusion bond is sought, a material for the intermediate conductor 44 may be selected that is known to diffusion bond relatively slowly.

Material choices for the intermediate conductor 44 include elemental silver of greater than 99% purity. Other elements that may be selected include gold, platinum, etc. The intermediate conductor 44 may be in foil form, including, for example, a thickness of up to 0.5 mm. In an exemplary embodiment the foil is 0.25 mm thick. This has been found to be chemically stable to above 850° C. A single layer may be used. Material choices for the mesh 48 include a conductor such as a metal or a metal alloy with an oxidation point well above the intended usage temperature. In an exemplary embodiment a steel or nickel Monel® fine wire (approximately 34 AWG) mesh may be used, which is chemically stable to 550° C. Silver and/or gold or other refractive metals may be used for the mesh in higher temperature environments. Copper may be used for the intermediate conductor 44 and/or the mesh 48 but only for environments not approaching 400° C., at which temperature copper tends to oxidize. The CMC material of structural member 52 is chemically stable and relatively rigid to above 1000° C. Steel may be used for the bolts 20 and the compliant fastener component 50 since it is chemically stable to above 575° C.

A fully assembled electrical device with ten (10) electrical arrangements 10 was electrically tested continuously at 450° C. for 216 hours, and no degradation of the electrical performance was detected. Electrical connections made using the electrical arrangement 10 were tested for over thirty (30) hours of vibration testing and also in a vibrating heated test rig up to 400° C. for (10) hours. No failures or degradation of the electrical contacts were detected.

Figure 5:
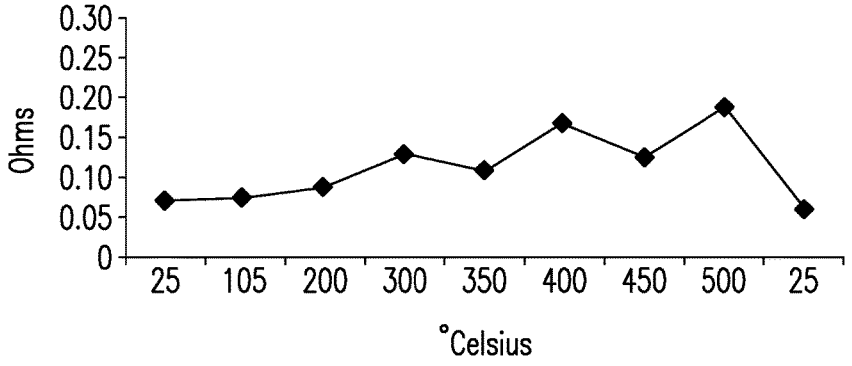
FIG. 5 is a graph of performance of the electrical arrangement of FIG. 1 when used in a high temperature environment.

Frequency performance of electrical connections is also important. The electrical arrangement 10 shows resistance of less than 0.3 ohms per connection at direct current (DC), 700 kHz, and 70 MHz over a temperature range of 25° C. to 500° C. and then back to 25° C. FIG. 5 charts actual results experienced for DC performance. Variations visible in the chart included those caused by the device under test; the connections themselves were more stable than shown. It is also important to note that once the temperature dropped back to 25° C. the electrical resistance reduced accordingly. Many prior art electrical connections oxidize at elevated temperatures and this increases the electrical resistance at the connection. Upon cooling the oxidation and associated increased electrical resistance remain. In contrast, as shown at the right end of the chart, when the temperature decreased so did the electrical resistance of the electrical arrangement 10. This repeatability represents another improvement in the art.

Figure 6:
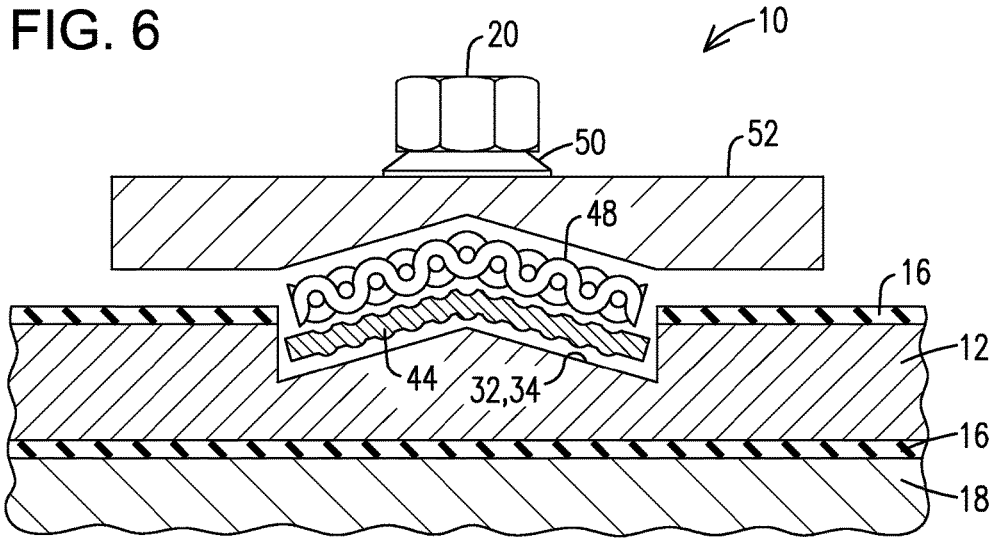
FIGS. 6-7 show alternate exemplary embodiments of the electrical arrangement along line A-A of FIG. 1.
Figure 7:
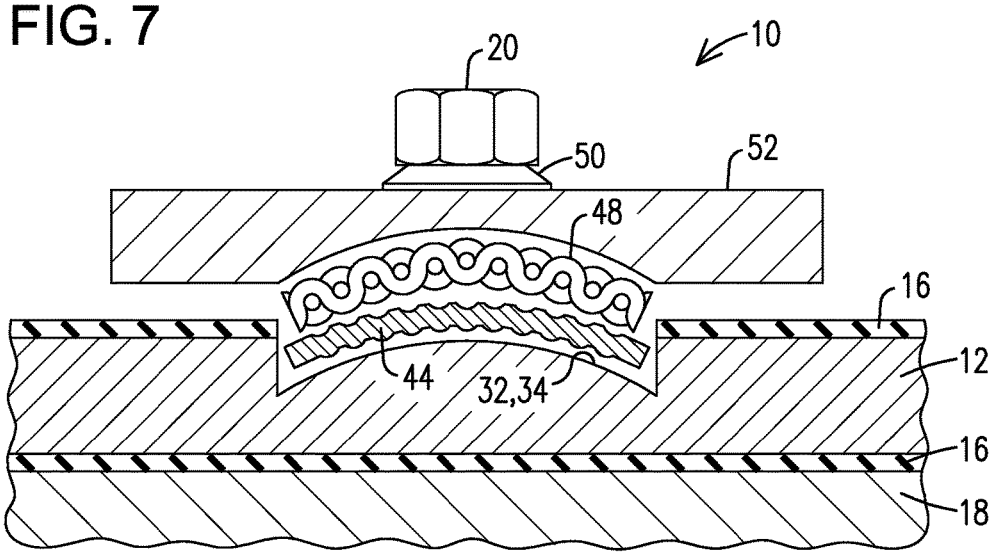

While the first and second contact areas 34, 40 are shown in this exemplary embodiment as both being generally planar, other shapes can be used with the principles disclosed herein. For example, as shown in FIGS. 6-7 which are taken along A-A in FIG. 1, a cross section of the first and second contact areas 34, 40 could be V-shaped, or curved etc. So long as the intermediate conductor 44 can slide as disclosed, any shape can be used.

Figure 8:
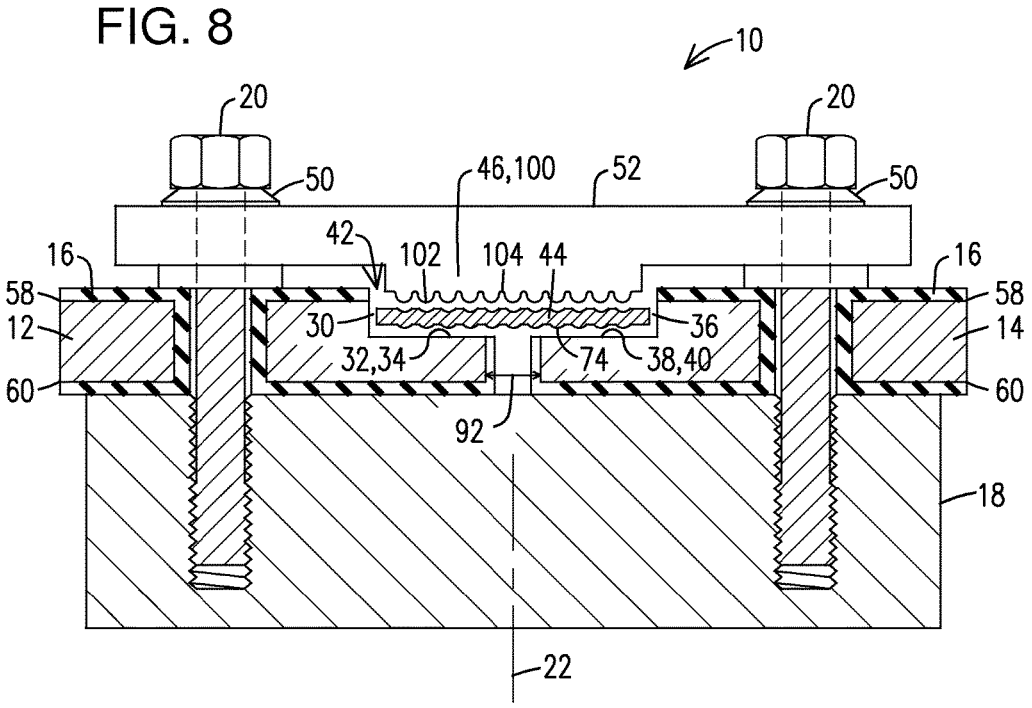
FIG. 8 is a side cross section of an alternate exemplary embodiment of the electrical arrangement.

FIG. 8 shows alternate exemplary embodiments of the electrical arrangement 10 where the dimpling structure 46 is not the metal mesh 48, but is instead incorporated into a protrusion 100 integral with the structural member 52 and extending down into the compartment 42. A plurality of peaks 102 disposed on a bottom side 104 of the protrusion 100 press into and deform the intermediate conductor 44 and form the plurality of raised contact points 74. The structural member 52 may have a coefficient of thermal expansion selected to match the intermediate conductor 44 such that there is no relative movement during thermal cycles.

Alternately, the structural member 52 may have a different coefficient of thermal expansion. For example, if the structural member 52 is a CMC with a relatively low coefficient of thermal expansion, the plurality of peaks 102 may restrict the plurality of raised contact points 74 of the intermediate conductor 44 so that any expansion of the intermediate conductor 44 occurs in between each raised contact point 74. In this exemplary embodiment, when the gap 92 grows but the plurality of raised contact points 74 are laterally constrained, the plurality of raised contact points 74 will essentially scrape along the first and second contact areas 34, 40. This scraping helps ensure a good electrical contact is made. The scraping may also recover a good electrical contact if oxidation did form by laterally moving the raised contact point 74 off the formed oxidation during one part of the thermal cycle. This re-establishes good electrical contact for that raised contact point 74. During the return part of the thermal cycle the scraping that occurs may scrape through the existing oxidation, thereby re-establishing good electrical contact for that raised contact point 74 where previously there was oxidation.

Figure 9:
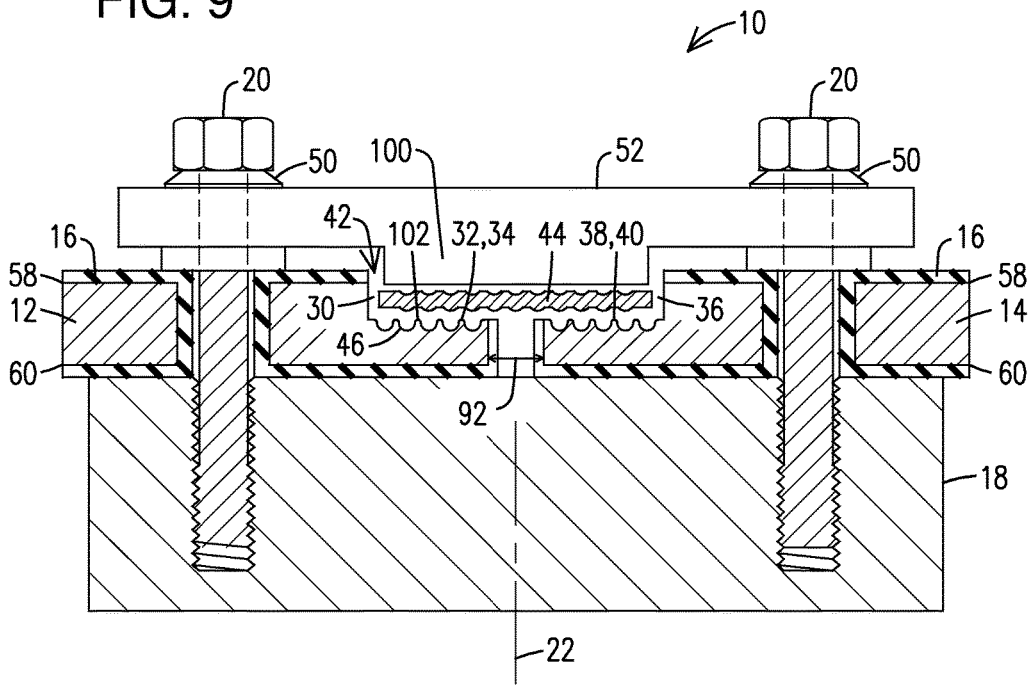
FIG. 9 is a side cross section of another alternate exemplary embodiment of the electrical arrangement.

FIG. 9 shows another alternate exemplary embodiments of the electrical arrangement 10 where the dimpling structure 46 is the protrusion 100 provides compression and where the plurality of peaks 102 are incorporated into the first and second contact areas 34, 40. In this exemplary embodiment the intermediate conductor 44 may want to interlock with the first and second contact areas 34, 40, so care must be taken to ensure there is enough compressive strength to ensure good contact, but not so much as to prevent the intermediate conductor 44 from sliding relative to the first and second contact areas 34, 40. Alternately, compressive strength could be increased if the intermediate conductor 44 is installed initially with a bow 74 in the gap 92 (i.e. the intermediate conductor 44 is pre-bowed). In yet another embodiment the dimpling structure 46 may be media, such as metal or ceramic pellets, or grit etc. The media could be constrained to be within a recess (not shown) in the structural member 52, or within a bag or similar flexible container.

From the foregoing it can be seen that the inventor has developed an electrical connection that excels in electrical connectivity and vibration resistance in environments with extreme thermal cycling. Further, the electrical arrangement requires no heat to form and can be assembled in the field, thereby making maintenance and repairs less costly and less time consuming. For at least the foregoing reasons it represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An electrical arrangement, comprising:

a first conductor comprising a first generally planar contact area;

a second conductor comprising a second generally planar contact area;

an intermediate conductor comprising a first faying area overlying the first contact area and a second faying area overlying the second contact area; wherein the first conductor comprises a first conductor recess and the first contact area is disposed at a bottom of the first conductor recess, wherein the second conductor comprises a second conductor recess and the second contact area is disposed at a bottom of the second conductor recess, and wherein the first conductor recess and the second conductor recess cooperate to form a compartment in which the intermediate conductor resides;

a compression arrangement configured to compress the first faying area and the first contact area toward each other and to compress the second faying area and the second contact area toward each other; and a dimpling structure effective to create plural contact points between the first faying area and the first contact area and between the second faying area and the second contact area when the first and the second faying areas and the first and second contact areas are compressed toward each other by the compression arrangement, wherein the dimpling structure creates the plural contact points by deforming the intermediate conductor on a non-contact side when compressed, the deforming creating raised contact points on the first and second faying areas, wherein the compression arrangement comprises a structural member disposed on an opposite side of the intermediate conductor than the contact side, wherein the structural member overlies the first and second faying areas and effects the compression, wherein the first and second contact areas are disposed on the contact side of the intermediate conductor, wherein the dimpling structure comprises a mesh disposed on a side of the intermediate conductor opposed the contact side, and wherein the mesh effects the creation of the raised contact points on the first and second faying areas, and wherein the intermediate conductor is configured to slide on at least one of the first contact area and the second contact area to accommodate relative movement between the first contact area and the second contact area.

2. The electrical arrangement of claim 1, wherein the mesh comprises a metal wire mesh.

3. The electrical arrangement of claim 1, wherein the intermediate conductor comprises a foil comprising elemental metal up to 0.5 mm thick.

4. The electrical arrangement of claim 1, wherein when the first and the second faying areas and the first and second contact areas are compressed toward each other frictional forces there between result, and wherein the intermediate member comprises a tensile yield strength that is greater than the frictional forces.

5. The electrical arrangement of claim 1, wherein the first and second contact areas are disposed on a contact side of the intermediate conductor, and wherein the compression arrangement comprises a structural member that:

is disposed on an opposite side of the intermediate conductor than the contact side;

overlies the first and second faying areas; and effects the compression.

6. The electrical arrangement of claim 5, wherein the structural member comprises a ceramic matrix composite.

7. The electrical arrangement of claim 1, wherein the electrical arrangement is free of metallurgical bonds.

8. The electrical arrangement of claim 1 wherein the electrical arrangement is configured to enable the first and second faying areas to settle into respective equilibrium positions relative to the respective first and second contact areas during operation in a gas turbine engine, and wherein a material of the intermediate conductor is selected to enable the plural contact points to diffusion bond with the first and second contact areas during subsequent operation of the gas turbine engine.

9. An electrical arrangement, comprising:

an intermediate conductor comprising a compliant material;

a dimpling structure overlying the intermediate conductor;

a first conductor comprising a first conductor recess comprising a bottom that defines a first contact area;

a second conductor comprising a second conductor recess comprising a bottom that defines a second contact area, wherein the first conductor recess and the second conductor recess cooperate to form a compartment in which the intermediate conductor resides; and a compression arrangement overlying the compartment and configured: to compress the intermediate conductor onto the first and second contact areas and to press the dimpling structure into and deform the intermediate conductor, wherein the intermediate conductor is configured to slide on at least one of the first contact area and the second contact area to accommodate relative movement between the first contact area and the second contact area, wherein the compression arrangement comprises a structural member overlying the intermediate conductor, and wherein the dimpling structure comprises a mesh disposed between the structural member and the intermediate conductor.

10. An electrical arrangement comprising:

a first conductor comprising a first contact area at a first conductor end;

a second conductor comprising a second contact area at a second conductor end, wherein the first and second conductors are positioned end to end;

an intermediate conductor comprising a compliant material and a first faying area overlying the first contact area and a second faying area overlying the second contact area; wherein the first conductor comprises a first conductor recess and the first contact area is disposed at a bottom of the first conductor recess, wherein the second conductor comprises a second conductor recess and the second contact area is disposed at a bottom of the second conductor recess, and wherein the first conductor recess and the second conductor recess cooperate to form a compartment in which the intermediate conductor resides;

a dimpling structure overlying the first faying area and the second faying area;

a compression arrangement comprising a structural member that overlies the dimpling structure, and a backing member that underlies the first conductor end and the second conductor end, the structural member and the backing member secured to each other and configured to sandwich and compress the first faying area and the first contact area toward each other, to sandwich and compress the second faying area and the second contact area toward each other, and to sandwich and compress the dimpling structure into the intermediate conductor, thereby dimpling the intermediate conductor, wherein the intermediate conductor is configured to slide on at least one of the first contact area and the second contact area to accommodate relative movement between the first contact area and the second contact area, and wherein the structural member comprises a ceramic matrix composite, and wherein the dimpling structure comprises a metal mesh.

11. The electrical arrangement of claim 10, wherein the electrical arrangement comprises no solder joints.

12. The electrical arrangement of claim 10, wherein the compression arrangement further comprises a fastener securing the structural member to the backing member, and a compliant fastener component between the fastener and the structural member.

* * * * *